US012490844B2

(12) United States Patent
Millman et al.

(10) Patent No.: US 12,490,844 B2
(45) Date of Patent: Dec. 9, 2025

(54) DISPLAY ASSEMBLY AND INTERLOCKING FASTENER THEREOF

(71) Applicant: Gallery Blocks LLC, Hunt Valley, MD (US)

(72) Inventors: Ryan J. Millman, Hunt Valley, MD (US); Cheyne J. Smith, Westminster, MD (US)

(73) Assignee: Gallery Blocks LLC, Hunt Valley, MD (US)

( * ) Notice: Subject to any disclaimer, the term of this patent is extended or adjusted under 35 U.S.C. 154(b) by 0 days.

(21) Appl. No.: 18/773,233

(22) Filed: Jul. 15, 2024

(65) Prior Publication Data

US 2025/0049235 A1 Feb. 13, 2025

Related U.S. Application Data

(63) Continuation of application No. 17/949,154, filed on Sep. 20, 2022, now Pat. No. 12,035,824, which is a (Continued)

(51) Int. Cl.
*A47G 1/17* (2006.01)
*A47G 1/06* (2006.01)

(Continued)

(52) U.S. Cl.
CPC ..... *A47G 1/17* (2013.01); *A47G 1/0633* (2013.01); *A47G 1/14* (2013.01); *A47G 1/16* (2013.01); *A47G 2001/145* (2013.01)

(58) Field of Classification Search
CPC .. B65D 11/1866; B65D 11/186; B65D 85/00; B65D 5/643; B65D 5/2066;

(Continued)

(56) References Cited

U.S. PATENT DOCUMENTS 933,454 A * 9/1909 Hudson ..... B65D 5/643 229/126
1,707,680 A * 4/1929 Norwood ..... B65D 5/302 229/157

(Continued)

FOREIGN PATENT DOCUMENTS

GB 2457005 A 8/2009

OTHER PUBLICATIONS

International Search Report and Written Opinion of the International Searching Authority directed to related International Patent Application No. PCT/US2018/15898, mailed Apr. 24, 2018, with attached English-language translation; 7 pages.

*Primary Examiner* — Cassandra Davis
(74) *Attorney, Agent, or Firm* — Sterne, Kessler, Goldstein & Fox P.L.L.C.

(57) ABSTRACT

A fastener for an image display assembly comprising a polygonal planar body having a ventral surface with at least one fastening member extending from the ventral surface. The fastening member comprises a fastening member body and at least one cantilever tab extending from the fastening member body. Each cantilever tab comprises a fastener retainer facing the ventral surface. Also provided is an image display assembly comprising retaining features; an assembled image display comprising said image display assembly and said fastener; a kit comprising said image display assembly and said fastener; a method of creating an image display; and use of said image display assembly and said fastener to create an image display.

20 Claims, 14 Drawing Sheets

Related U.S. Application Data continuation of application No. 17/012,847, filed on Sep. 4, 2020, now Pat. No. 11,445,839, which is a continuation of application No. 15/883,527, filed on Jan. 30, 2018, now Pat. No. 10,765,238, which is a continuation of application No. 14/936,105, filed on Nov. 9, 2015, now abandoned.

(60) Provisional application No. 62/452,760, filed on Jan. 31, 2017.

(51) Int. Cl.
*A47G 1/14* (2006.01)
*A47G 1/16* (2006.01)

(58) Field of Classification Search
CPC .. B65D 5/2009; B65D 5/48008; B65D 5/505; B65D 5/6605; B65D 2571/0066; B65D 71/16; B65D 71/18; B65D 2571/0016; B65D 2575/586; B65D 81/368; A45C 7/0036; A45C 11/16; A47G 1/17; A47G 1/0633; A47G 1/14; A47G 1/16; A47G 2001/145
See application file for complete search history.

(56) References Cited

U.S. PATENT DOCUMENTS 1,894,226 A * 1/1933 Ross ..... B65D 5/26 229/160
3,252,650 A 5/1966 Pryor
3,416,765 A 12/1968 Ebner
3,771,246 A 11/1973 Ebner
3,782,620 A 1/1974 Eichholz
4,339,983 A 7/1982 Okamura et al.
4,793,725 A 12/1988 Cheng
5,121,526 A 6/1992 Burkard et al.
D341,081 S 11/1993 Chiodo et al.
5,427,309 A 6/1995 Voss
5,516,036 A 5/1996 Maultasch et al.
6,595,825 B1 7/2003 De Wilde
6,792,709 B1 9/2004 Fine et al.
7,284,688 B1 10/2007 Barsness
8,840,010 B2 * 9/2014 Wilson ..... B65D 5/6647 24/562
8,991,083 B1 3/2015 Pohlman, Jr.
9,738,108 B2 8/2017 Ridless
10,526,108 B1 1/2020 Wilson et al.
10,737,829 B1 8/2020 Wilson et al.
10,765,238 B2 9/2020 Millman et al.
11,445,839 B2 9/2022 Millman et al.
12,035,824 B2 7/2024 Millman et al.
2004/0074956 A1 4/2004 Sax et al.
2008/0172918 A1 7/2008 Weiss
2010/0270181 A1 10/2010 Morgan
2011/0016759 A1 1/2011 Ramos-Gonzalez et al.
2013/0219761 A1 8/2013 Edmondson et al.
2014/0068981 A1 3/2014 Cheng et al.
2016/0021928 A1 1/2016 Fath
2016/0078786 A1 3/2016 Wilkinson, Jr.
2020/0384658 A1 12/2020 Koizumi

* cited by examiner

DISPLAY ASSEMBLY AND INTERLOCKING FASTENER THEREOF

CROSS-REFERENCE TO RELATED APPLICATIONS

This application is a continuation of U.S. application Ser. No. 17/949,154, filed Sep. 20, 2022, which is a continuation of U.S. application Ser. No. 17/012,847, filed Sep. 4, 2020, which is a continuation of U.S. application Ser. No. 15/883,527, filed Jan. 30, 2018, which is a continuation in part of U.S. application Ser. No. 14/936,105, filed Nov. 9, 2015, and claims priority to U.S. provisional application No. 62/452,760 filed Jan. 31, 2017, the contents of all of which are hereby incorporated by reference in their entireties.

BACKGROUND

The mounting and display of painted or printed images is typically accomplished by stretching a canvas or other material containing an image over a wooden or metal stretcher frame or mounting an image to canvas or other support structure for framing and subsequent display. The images are generally secured to the backside of the frame with staples or adhesive. These methods do not provide for an image that is professional in appearance. Other methods have been developed that provide a flat mounting surface, for transforming a flat image mounting surface into a frame upon folding of the portions of the base along indentations. These methods, however, require secondary support to secure the assembled position, to resist warping of the edges, such as rigid back panels, inner cavity supports such as foam, and the like. There is a need for new support structures and image substrates that address such disadvantages and provide for a technically efficient image display providing a professional, artistic appearance, and where the integrity of the image is not compromised.

SUMMARY

Disclosed herein is an image display assembly wherein an image comprising an image printed on a material such as canvas or paper, is mounted to an image side of a foldable image display base, that when folded into an assembled image display structure comprising a plurality of nearly-perfect 90° corners of the display, and wherein the structure is held together by an interlocking fastener that attaches to one or more distal ends of base segments of the image display base, and forms a non-image panel of the image display. The present invention provides an extremely efficient way to produce an artistic display, either as a display hanging from a wall or other support means, or as a free-standing display, and drastically reduces production time and cost when compared to other comparable image display systems, yet provides an extremely high quality display.

In one aspect, an interlocking fastener for an image display assembly comprises a convex equiangular polygonal planar body, comprising a dorsal surface and a ventral surface; and at least one fastening member extending from the ventral surface; each fastening member comprising a fastening member body and at least one cantilever tab extending from the fastening member body; each cantilever tab comprising a retainer facing the ventral surface, wherein retainer is configured to engage a retainer feature of an image display assembly.

In one embodiment, the fastening member body has an average width in the region between the ventral surface and the cantilever tab(s) that is greater than the average distance between the retainer and the ventral surface. In another embodiment, the average width is at least 1.5 times the average distance, optionally wherein the average width is at least 2, 3 or 4 times the average distance. In another embodiment, the convex equiangular polygonal planar body is a regular convex polygonal planar body; further including a substantially rectangular planar body, wherein the convex equiangular planar body is dimensioned to provide a side of an assembled image display assembly, optionally wherein the side is a non-image side.

In another embodiment the fastener comprises at least one hanging feature, wherein the at least one hanging feature comprises at least one cutout in the convex equiangular polygonal planar body.

In another embodiment, the fastener comprises a single fastening member comprising a plurality of cantilever tabs, wherein the plurality of cantilever tabs is equal to the number of polygonal edges of the polygonal planar body, wherein the single fastening member is located substantially centrally in the ventral surface, wherein the polygonal planar body is a substantially rectangular planar body, wherein the cantilever tabs are configured in a petal arrangement around the fastener member body.

In another embodiment the fastening member is proximate a given vertex when the center of the fastening members body is at least 50% (e.g, at least 60%, 70% or 80%) of the distance from the center of the ventral surface of the planar body to the given vertex, wherein each fastening member comprises two cantilever tabs, a first cantilever tab oriented to point toward the first polygonal edge that forms the proximate vertex, and a second cantilever tab oriented to point toward the second polygonal edge the forms the proximate vertex.

Also described herein is an image display assembly comprises a base having a front (image) face for securing an image or other display material for display, and a non-image face, the non-image face comprising a plurality of linear v-grooves, wherein the plurality of linear v-grooves segment the base into proximal foldable segments extending between at least two linear v-grooves and distal foldable segments extending from a single linear v-groove, each distal foldable segment comprising at least one retaining feature positioned in its portion of the non-image face of base segment adapted for engagement of a retainer of a fastener, wherein folding of the segments assembles the base into a support structure comprising a plurality of corners and a hollow, the distal segments when folded located proximate to each other and defining an entrance to the hollow, thereby forming a partially assembled base comprising at least one image display face formed from at least a portion of the front face.

In one aspect, the proximal folded segment opposite to the entrance to the hollow forms a convex equiangular polygonal shaped portion of the front face, wherein the entrance to the hollow is adapted to be covered by the fastener when each retainer of said fastener is engaged with a corresponding retaining feature of each distal foldable segment; and optionally wherein the convex equiangular polygonal planar body has substantially the same polygonal shape as the convex equiangular polygonal shaped portion of the front face.

A kit of parts is also provided, comprising an image display assembly; an image sheet; and a fastener. A method of creating an image display is also provided, comprising: providing an image display assembly; removing the removable protective layer and applying at least one image to the adhesive layer at least a portion of the image display face; folding the segments to assemble the base into a support structure comprising a plurality of corners and a hollow, the distal segments when folded located proximate to each other and defining an entrance to the hollow, thereby forming a partially assembled base comprising at least one image display face formed from at least a portion of the front face; attaching a fastener to the partially assembled base, the attaching comprising covering the entrance to the hollow with the fastener, such that each fastening member extends into the hollow, and engaging each retainer of the fastener with a corresponding retaining feature of the base to form an assembled base.

In another aspect, an image sheet comprises perforations defining an image area with an image printed therein, wherein the outer perimeter of the perforated image area corresponds to the perimeter of at least a portion of the image display base.

DETAILED DESCRIPTION

Figure 1:
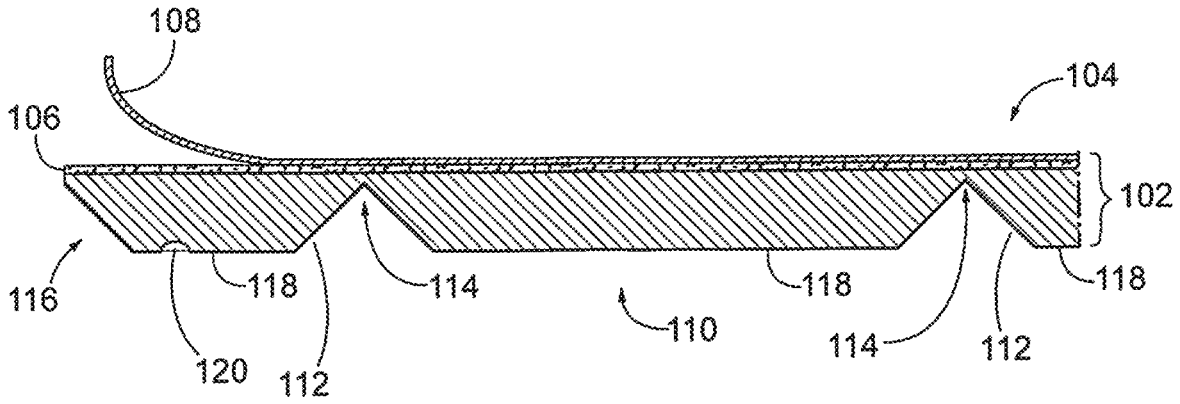
FIG. 1 shows a cross-sectional view of an image display (partial) assembly base (unassembled) according to one embodiment of the invention.

Described herein is an image display assembly comprising a fastener, an image, and a base, the base comprising a front (image) face comprising an adhesive layer for securing the image, and a non-image face, the non-image face comprising a plurality of linear v-grooves, wherein the plurality of linear v-grooves segment the base into one or more foldable segments, each end segment configured with one or more retainer features, and wherein upon folding of the segments along the v-grooves assemble the base into a support structure comprising a plurality of corners, thereby forming an assembled base comprising at least one image display face formed from at least a portion of the front (image) face, and a non-image face formed of the fastener.

Exemplary Base

In one embodiment, the base is comprised of a substantially rigid material. In one embodiment, the base may be constructed of a single layer of material or of multiple layers of material. The material of the base may be selected from at least one of plastic, paperboard, cardboard, fiberboard, wood, metal, aluminum, or other synthetic or natural materials, or any suitable combinations thereof. In one embodiment, the base is comprised of a medium density fiberboard (MDF). In one embodiment, the base may have a thickness ranging from approximately 1116 inch to 112 inch, although other base dimensions are contemplated.

The base is designed to provide one or more image mounting surfaces for adhering one or more images thereto. The overall dimensions of the image display provide for an assembled image display of dimensions may be, for example: a 1×1 up to 5×5 inch image or larger; 3×5 inch image; a 5×7 inch images; an 8×10 inch image; a 11×14 inch image; 16×20 inch image; 20×30 inch image; 22×32 inch image, or any other suitable image size or equivalent thereof, and including Si/metric measurements, such as 24×30 cm; 30×30 cm; 40×40 cm; 40×50 cm; 50×50 cm; 60×80 cm. It is envisioned that the overall dimensions may be customized.

The periphery of the base comprises distal edges that are angled at about 45® (e.g. at 43-47° or at) 45°, along all or a portion of the periphery, thereby providing for alignment of edges, if two edges are brought together in alignment. The base is configured with one or more retainer features, which may be dents, protrusions, notches, magnetic features, snap features etc., intended to engage a fastener.

In one embodiment, the base is configured such that, when assembled, the assembled base forms a prism optionally with an end face removed, wherein the side faces of the prism are rectangles, or wherein the prism is a triangular prism or rectangular prism, or wherein the prism is a cube.

Exemplary Groove System

In one embodiment, the base is configured with an arrangement of linear v-grooves on the non-image side of the base, and that divide the base into segments. The resulting segments may then be folded inward along the v-groove, with the folded segment of the base forming a corner segment. With this arrangement, various overall shapes of the image display assembly are envisioned and may be assembled based on the arrangement and positioning of the v-grooves along the base.

In one embodiment, the v-grooves are created by a mitre bit on a computerized numerical control (CNC) router, with a bit size in a range of 90-93 degrees. The depth of the v-groove is of a depth that permits inward folding of the segments of the base in order to create a 90° angled corner, but the v-groove does not fully traverse the base. In one embodiment, the v-groove depth is in a depth ranging from approximately 0.05 to 0.02 inches away from the image side of the base (ie, leaving a base thickness in a thickness range of 0.05 to 0.02 inches), alternatively, less than 0.004 inches away from the image side of the base; thus leaving a base thickness of less than 0.004 inches remaining at the end of the v-groove. In another embodiment the v-groove depth is at a depth ranging from approximately less than or up to 0.004 inches away from the image side of the base, leaving a base thickness of essentially less than 0.004. In yet another embodiment the v-groove depth is at a depth equal to the thickness of the base, and where the v-groove traverses the non-image side of the base, ending at the adhesive layer. It is understood that overall depth will vary depending on the thickness of the base, and the type of materials used as the base.

In an embodiment, the v-grooves have a depth of varying thickness, such as at least 50% of the thickness of the base, or a lower percentage, optionally wherein the grooves have a depth at least, or greater than, 60% of the thickness of the base, further optionally wherein the grooves have a depth of at least, or greater than, 70% of the thickness of the base, still further optionally wherein the grooves have a depth of at least, or greater than, 80% of the thickness of the base, or a depth of a higher percentage.

In one embodiment, the v-grooves have an angle in a range of 85 to 95° (e.g. 87 to 93°), optionally, wherein the v-grooves have an angle of about 90°, and preferably an angle of about 91°. For example the v-grooves may have an angle in the range of 89 to 92°.

In one embodiment, the segments formed by the v-groove arrangement may be of varying widths and lengths, thereby permitting multiple display assembly configurations. In one embodiment, v-groove placement may result in a plurality of segments of various widths and lengths, which result in an overall assembly conforming to specific dimensions. In one embodiment, a depth of a side wall formed upon folding of segments of the base is in a range of 0.25 inches to 2.0 inches, although other depths are envisioned. In one embodiment, based on the overall dimensions (length and width) of the base and the arraignment of v-grooves, the resulting segments created on the base may be assembled to form an image display with for example: an 11×14 inch image display face, a 1.5 inch side wall, and a 11×14 inch fastener face, although dimensions of each side may be equivalent, with one or more image faces formed having equal dimensions.

Interlocking Fastener

In one embodiment, an interlocking fastener comprises a convex equiangular polygonal planar body (e.g. a generally rectangular planar body, or a generally regular convex polygonal planar body), comprising a dorsal surface and a ventral surface, the dorsal surface essentially flat and the ventral surface configured with one or more fastening members (e.g. 1, 2, 3, 4 fastening members) extending therefrom. Each fastening member comprises a fastening member body and one or more (e.g. 2, 3 or 4) cantilever tabs extending from the fastening member body. The fastening member body may be oriented substantially perpendicular (e.g. 90°+/−2, 5 or) 10° to the plane of the ventral surface. The cantilever tabs extend outward from the fastening member body and are generally oriented substantially parallel (e.g. within 2, 5 or 20° of parallel) to the ventral surface of the rectangular planar body, the orientation creating a space between a bottom surface of the cantilever tab and the ventral surface of the rectangular planar body, the width of the space corresponding to +/−10% (e.g. +/−5, 4, 3, 2 or 1%) of a thickness of the assembly base layer. Positioned near the end of each of the cantilever tabs is a fastener retainer on the bottom surface of the cantilever tab, the fastener retainer configured to engage with a retaining feature formed on an image display base end segment. When the fastener retainers are engaged with the corresponding retaining features of base end segments they form an interlocking fastening mechanism and secure an assembled base comprising at least one image display face, and a fastener face comprising the dorsal surface of the interlocking fastener. When assembled, the ventral surface of the fastener faces the interior (non-image side) of the assembled image display.

The retainer may be selected from one or more of a tab, protrusion, dint, cutout, notch, snap or magnetic feature. The retaining feature of the base end segment may be selected from one or more of a dint, cutout, notch, tab, protrusion, snap or magnetic feature. The retaining feature is selected to be complementary to the retainer, thereby providing an interlocking fastening mechanism. For example, the retainer may be a tab or protrusion, and the retaining feature may be a dint, cutout, or notch; e.g. the retainer may be a tab and the retaining feature may be a dint. For example, the retainer may be a dint, cutout, or notch and the retaining feature may be a tab or protrusion; e.g. the retainer may be a dint and the retaining feature may be a tab. For example, the retainer may be a magnet or other magnetized feature, and the retaining feature may be a corresponding magnet or magnetized feature, therefore forming a magnetic attachment between the retainer and the retainer feature.

In one embodiment, interlocking fastener is made of rigid, semi-rigid, or flexible material(s), such as plastic, fiberboard, paperboard, cardboard, wood, metal, or composite material, and/or combinations of suitable materials. The overall dimensions of the fastener may correspond to the dimensions of an image face of the assembled image display. In one embodiment, fastener forms a back or side panel (face) of an assembled image display and alternately, comprises one or more of an image affixed to the dorsal surface.

As shown in FIG. 2, the fastener may comprise a planar body of generally square shape with a dorsal surface and a ventral surface, the planar body having a perimeter of four essentially equal sides, a fastener member body positioned centrally on the ventral surface and protruding perpendicular from the ventral surface, with cantilever tabs extending from the fastener member body and extending parallel to the ventral surface, the cantilever tabs extending toward the outer perimeter of the planar body. The cantilever tabs may be configured in a petal arrangement around the fastener member body, with each cantilever tab oriented approximately parallel to two of the sides of the planar body and/or with each cantilever tab oriented at approximately 90°, 180° and 270° to the other cantilever tabs. The cantilever tabs of fastener each engage with a retainer feature on an end segment of the base layer, so that when the base layer is folded into a cube structure, the retainers (e.g. tabs) of the fastener interlock the fastener together with the base segment ends, thereby securing the ends of the assembled image display in the assembled position.

In another embodiment, as shown in FIG. 4, fastener comprises a planar body of generally rectangular shape, with a dorsal and ventral surface, the planar body having a perimeter comprising two opposing sides of equal length and two opposing sides of equal width, and a fastener member body positioned at each corner of the fastener, each fastener member body comprising a pair of cantilever tabs extending from the fastener member body toward the outer perimeter of the fastener, the tabs forming essentially a 90 degree angle opposite an outer corner of the fastener planar body. The pair of tabs are configured to secure the distal ends of base segments when assembling the base by folding the base segments and securing the distal ends of the base segments to form a rectangular-shaped image display, wherein the dorsal surface forms a back panel to the rectangular-shaped image display.

Protective Layer

In one embodiment, a protective layer is a layer of material, for example a synthetic material such as polymer or plastic, which is removable and capable of being peeled away from the adhesive layer of base layer. The protective layer may cover all, or a portion of the adhesive on the base and may be removed by peeling all or a portion of the protective layer away from the base.

Adhesive Layer

In one embodiment, an adhesive layer may be selected from adhesives including a polyvinyl acetate adhesive, hot melt adhesives, and/or pressure sensitive adhesives. In one embodiment, an adhesive layer comprises a double-sided adhesive film and may include a peel-away protective layer disposed on one of the sides of the adhesive. In one embodiment, the double-sided adhesive layer is applied to an image side (the image mounting side) of an image display base. In one embodiment, the adhesive layer covers all or a portion of the image side (image mounting side) of the display base.

Image for Display

In one embodiment, the image may be of various visual arts and mediums such as one or more of a photograph, a graphic design, a printed image or painted image, a collage, or other collection of assembled images, or other suitable image medium intended to be displayed. While it is envisioned that a single image is mounted on the base for display, the image display assembly is configured such that multiple images may be mounted. The images may be printed on paper, canvas or other materials. In another embodiment, the images may be constructed of materials such as paint, dyes, or other artistic materials, applied to a canvas or other fabric, or paper, and adhered to the image display.

In one particular embodiment, the image comprises a sheet with an image printed thereon, the sheet comprising an image area defined by a perforated perimeter, the image area and perforated perimeter essentially equal in shape and dimensions with the area of the image side of the unassembled base. The image may be separated from the sheet by releasing the perforations, and the resulting printed image may then be mounted onto the image face of the base.

Distal Ends of Base and Base Segments

In one embodiment, the base is generally planar and comprises distal ends that define the overall shape of the planar base. In another embodiment, the distal ends comprise corner-forming edges that are clipped at a 45 degree angle, to minimize interference of the distal ends upon assembly of the image display. In one embodiment, the distal ends of the non-image side of the planar base further comprises one or more retaining features (e.g. cutouts, dints, snaps or notches) of a size and shape that permits engagement with a retainer (e.g. tab) of interlocking fastening member, the retainer being of commensurate shape with the retaining feature. In one embodiment, the retainer may be a tab and the retaining feature may be an oval shaped cutout. In such an embodiment, the fastening tab of interlocking fastening member snaps securely into the oval shaped cutout, although the shape of the cutout or dint may be of various shapes and forms and depths. In another embodiment the retainer may be an oval shaped cutout and the retaining feature may be a tab. In such an embodiment the fastening cutout of interlocking fastening member snaps securely to the tab. In another embodiment, the retainer may be a magnet or other magnetized feature, and the retaining feature of distal ends may be a corresponding magnet or magnetized feature, therefore forming a magnetic attachment between the retainer and the retainer feature.

In one embodiment, the distal ends are configured as quarter segments that when folded inward to form a face of an image display, are attached to the fastener, each distal end secured with the interlocking fastening member, wherein the dorsal side of the fastener forms a face panel of the resulting structure, and the ventral surface of the fastener faces the hollow of the assembled image display. The face panel formed by the dorsal side of the fastener may further comprise an image, a decorative embellishment, or other ornamental feature(s). In another embodiment, the dorsal side of the fastener forms a back panel of an image display. Distal ends are sized, in part, according to the fastener dimensions. Each distal end comprises a tapered end that is narrower than the base of distal end adjacent the v-groove, and is of a length from the v-groove and terminating at the edge of the tapered end, the length corresponding to a length suitable for attaching with the fastener. The fastener terminal edge aligns with the v-groove forming the distal end segment, and the length of the distal end corresponding to a suitable attachment point of the distal end retainer feature to the retainer of fastener.

Also disclosed is a kit of parts for assembly of an image display, comprised of: a fastener comprising a base of rectangular shape, the base comprising a ventral side configured with fastening member and one or more fastener retainers and a dorsal side configured with an essentially flat surface and one or more optional hanging features; an image sheet; and a planar base with an image mounting/display side comprising an adhesive layer and an removable protective layer, and a non-image side comprising a plurality of v-grooves along the base segmenting the base into portions comprising base segments, the distal end segments further comprising retaining features, the segments of which are foldable along the v-grooves, such that the folded segments create corners resulting in a structure comprising one or more image display surfaces, upon assembly of the image display. The base may be proportioned with a v-groove arrangement and with distal edges configured with cutouts that, upon alignment with the fastening members of the fastener, result in an image display of a pre-determined size and shape, such as a 5×7 rectangular image display or a 2 inch or 3 inch cube-shaped mage display.

In one exemplary embodiment meant to be illustrative and not exhaustive, an unassembled image display assembly (base and adhesive layer) is of a thickness of approximately 0.125 inches, with a v-groove depth of approximately 0,115 inches inward from the non-image side, the v-grooves at an angle of 91 degrees and a width of approximately 0.2301 inches.

The planar base materials can be configured by shaping, cutting and modifying the materials comprising the planar base layer in a way that upon the addition of the v-grooves, permits assembly of the planar base materials into various support structure shapes (including triangular, rectangular, and cuboidal shapes), by inward folding of extensions or segments created by the v-grooves, which when folded inwardly along the v-groove, provide a substantially rigid support assembly on which an image can be affixed for display.

Turning now to the figures, in which are shown various embodiments of an image display assembly, in both unassembled and assembled forms.

FIG. 1 shows a cross-sectional view of a (partial) image display base 100 according to one embodiment of the present invention, as an unassembled image display. Shown in FIG. 1 is a planar base 102; an image face 104 comprising an adhesive layer 106 configured with a protective overlay 108, wherein upon removal of the protective overlay 108 an image to be displayed may be adhered, or mounted, to the image substrate; a non-image face 110 comprising a plurality of v-grooves 112 that extend inward toward the image face of the base, creating a hinge point 114 and segments 118; and retaining feature dint 120; and wherein the v-grooves are cut at an angle of width and depth that permits inward folding of the base on either side of the hinge point 114, and upon inward folding results in the formation of a corner segment of adjoining sides of the base on either side of the hinge point 114.

Figure 2A:
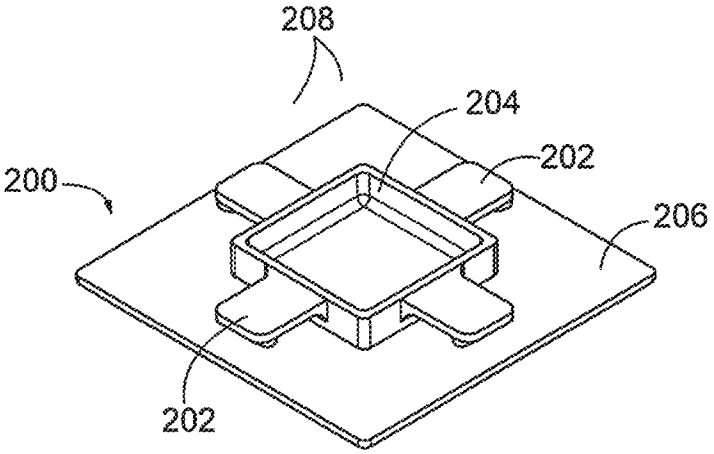
FIG. 2A-2D show various views of an interlocking fastener, which attaches to one or more distal ends of the image display base, the base configured for an image display comprising a cube-shaped structure (when fully assembled).
Figure 2B:
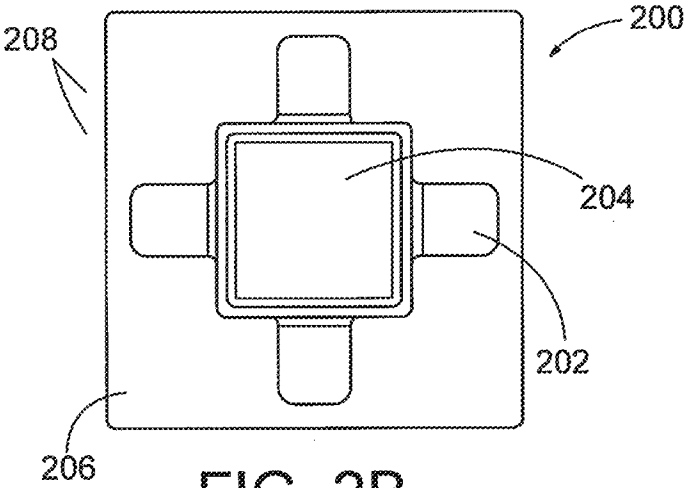
Figure 2C:
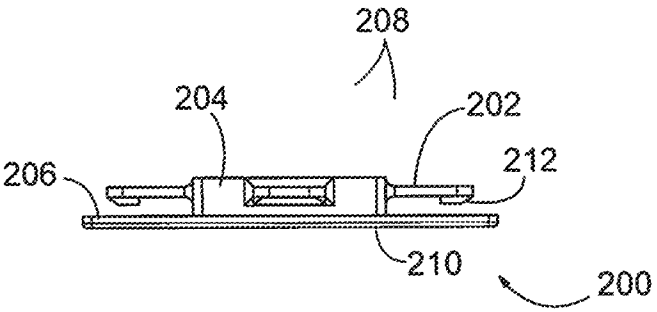
Figure 2D:
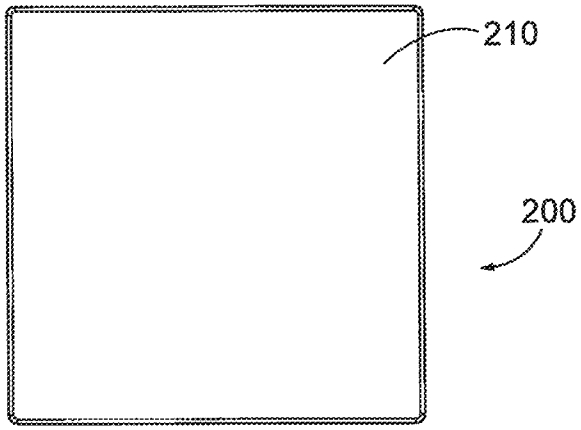

FIGS. 2A, 2B, 2C, 2D, collectively, show an assortment of views of an image display fastener 200 comprising a fastening member comprising a plurality of cantilever tabs 202 extending from a central fastening member body 204 of a base 206 of fastener 200. Base 206 is configured with a ventral surface or fastening (ventral) side 208, and (shown in FIGS. 2C and 2D) a dorsal surface or back panel (dorsal) side 210. FIG. 2C shows a side view of fastener 200 and interlocking tabs 212 extending from a ventral facing (underside) surface of each cantilever tab 202. Cantilever tabs 202 are positioned a distance from the surface of base 206 that accommodates the insertion of distal end of base segments, so that interlocking tabs 212 of fastening members snap into and engage the dint of the non-image side base segment surface (not shown).

Figure 3A:
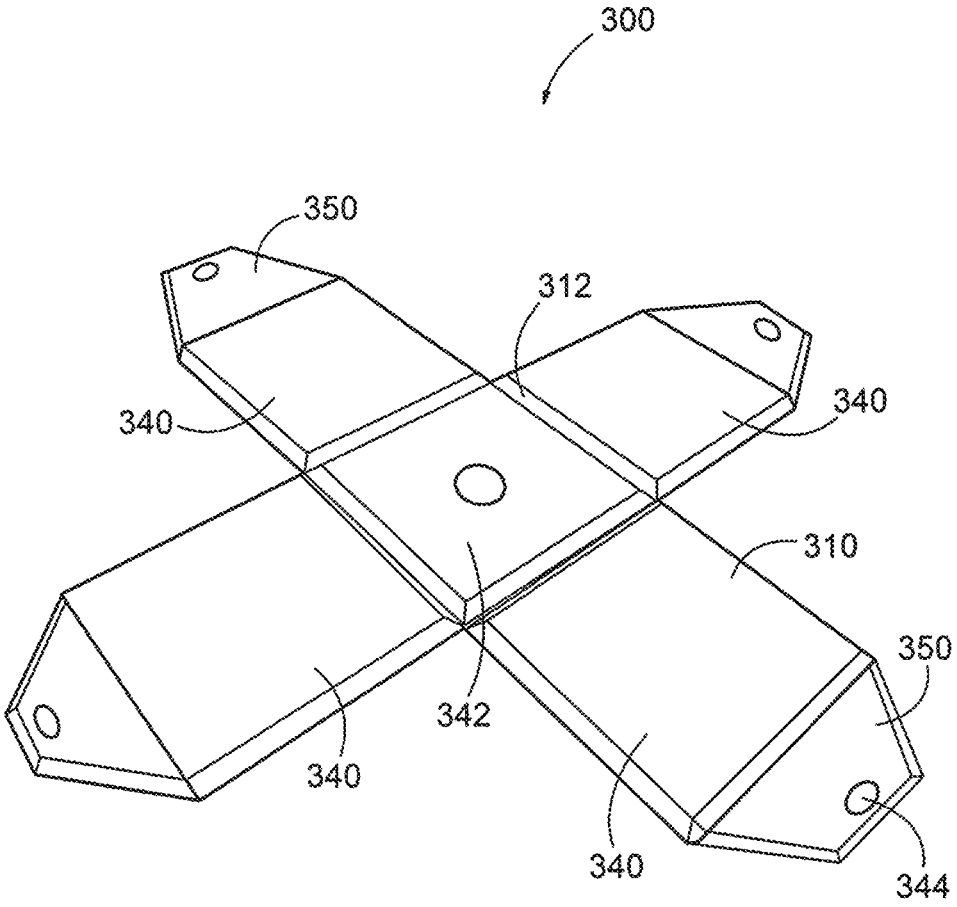
FIGS. 3A-3F show a front and back view, and partially-assembled and fully assembled view, of a cube-shaped image display, according to one embodiment of the invention.
Figure 3B:
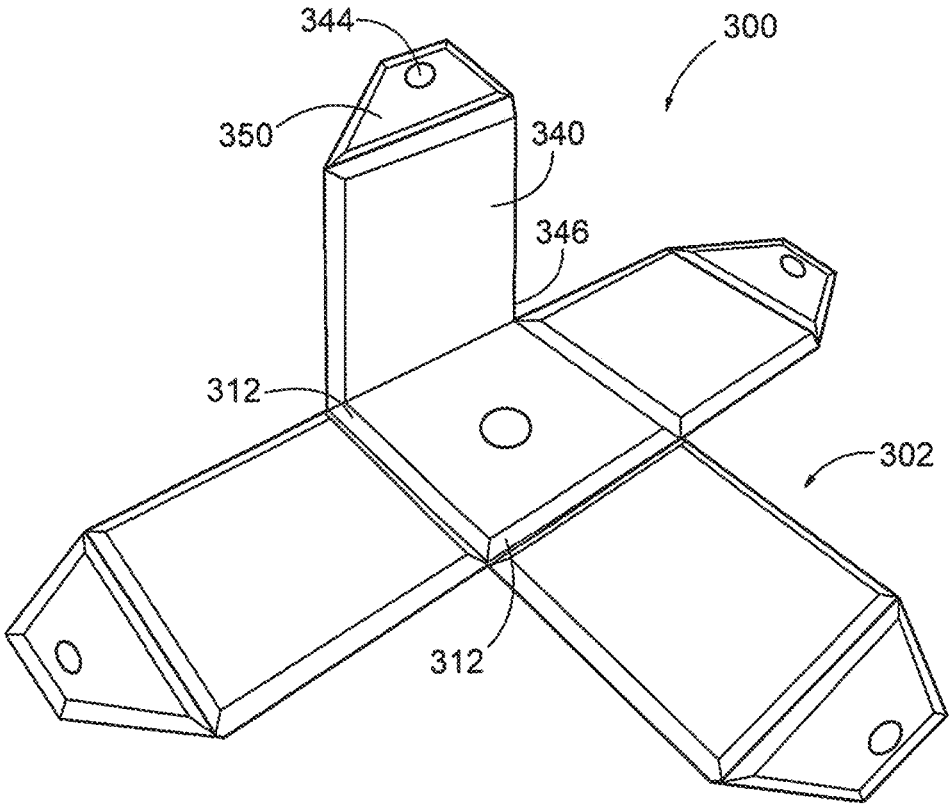
Figure 3C:
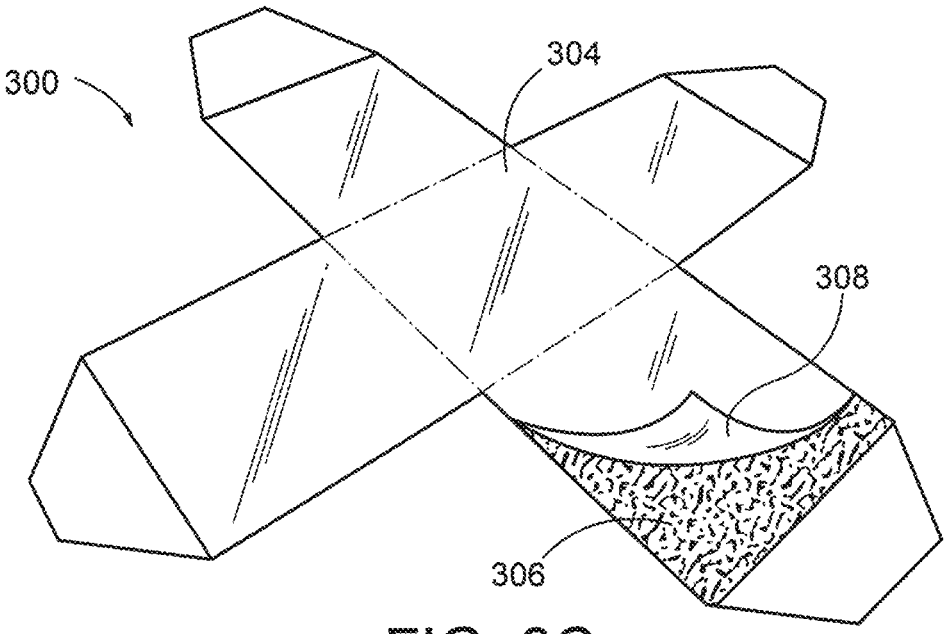

Shown in FIGS. 3A 3C, is an image display assembly 300 is configured as a cube-shaped image display comprised of a planar base 502 configured with four (4) linear v-grooves 312 on the non-image surface 310, the v-grooves segmenting the board into four foldable segments/extensions 340 extending from a center segment 342. Distal edges 350 of the segments are angled at 45® along the length of the extension 340. One or more dints 344 are positioned near the outer end of distal segments 350. In one embodiment, segments 340 are folded inward along each of the linear v-grooves 312, shown in FIG. 38, forming corner 346.

Figure 3D:
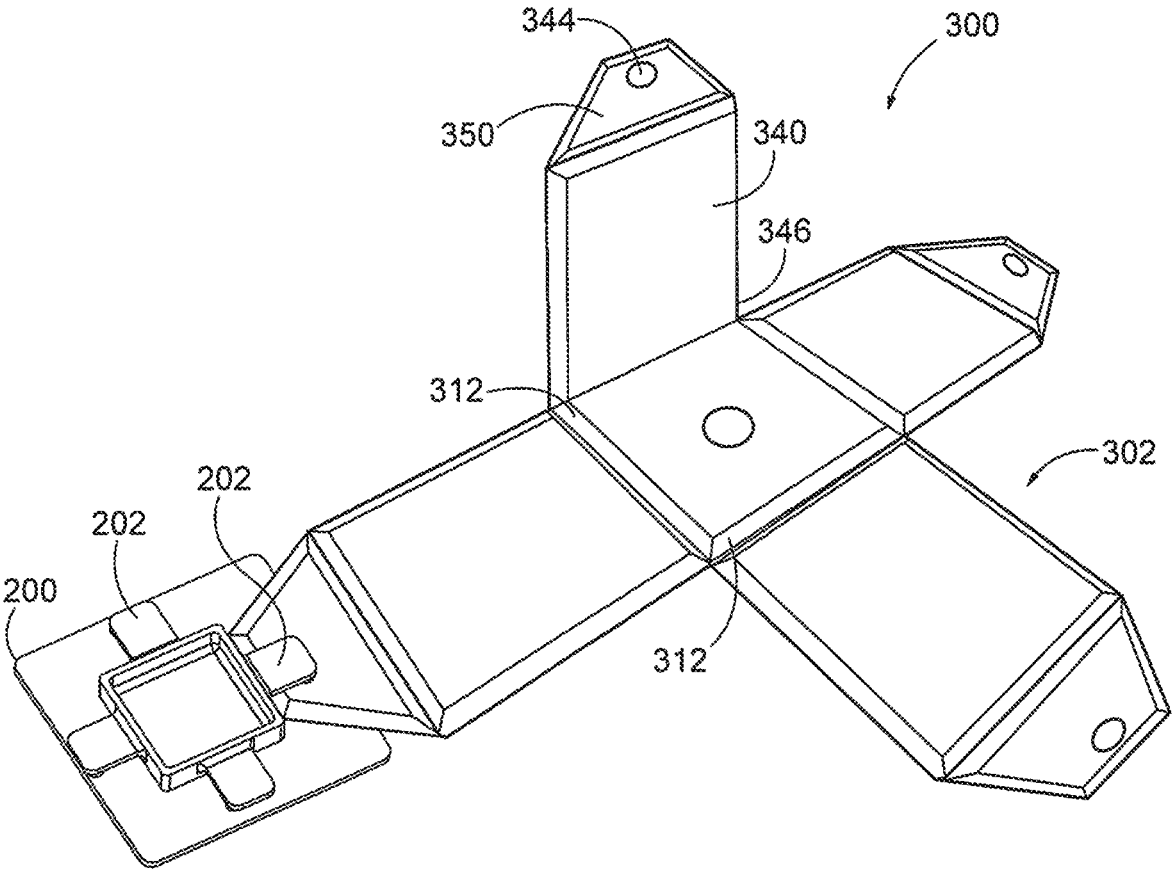
Figure 3E:
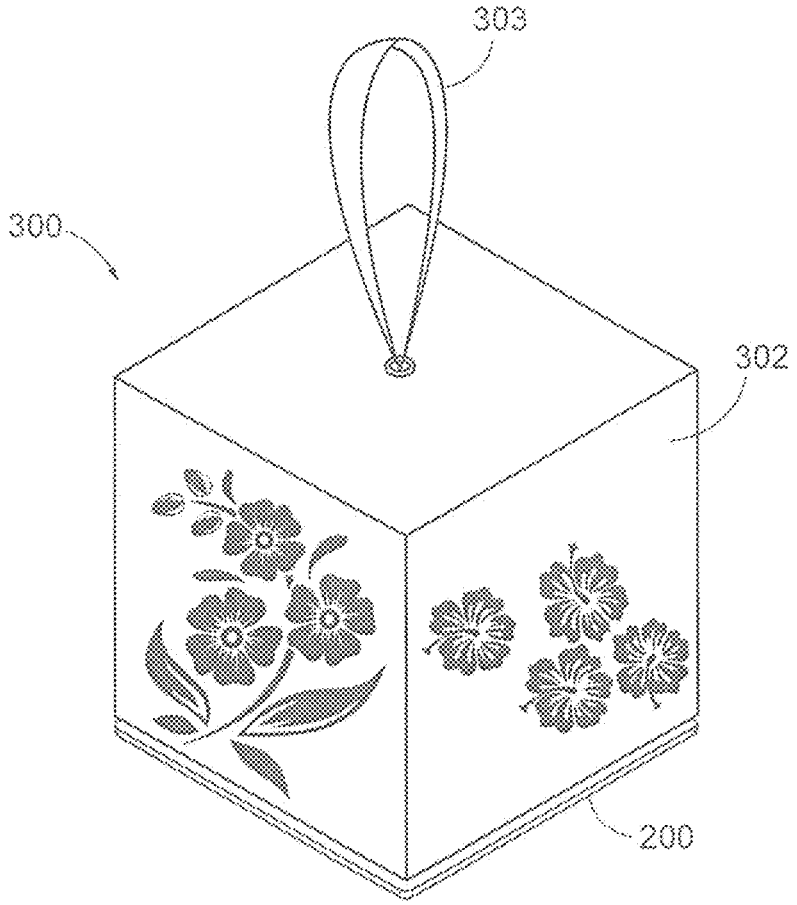
Figure 3F:
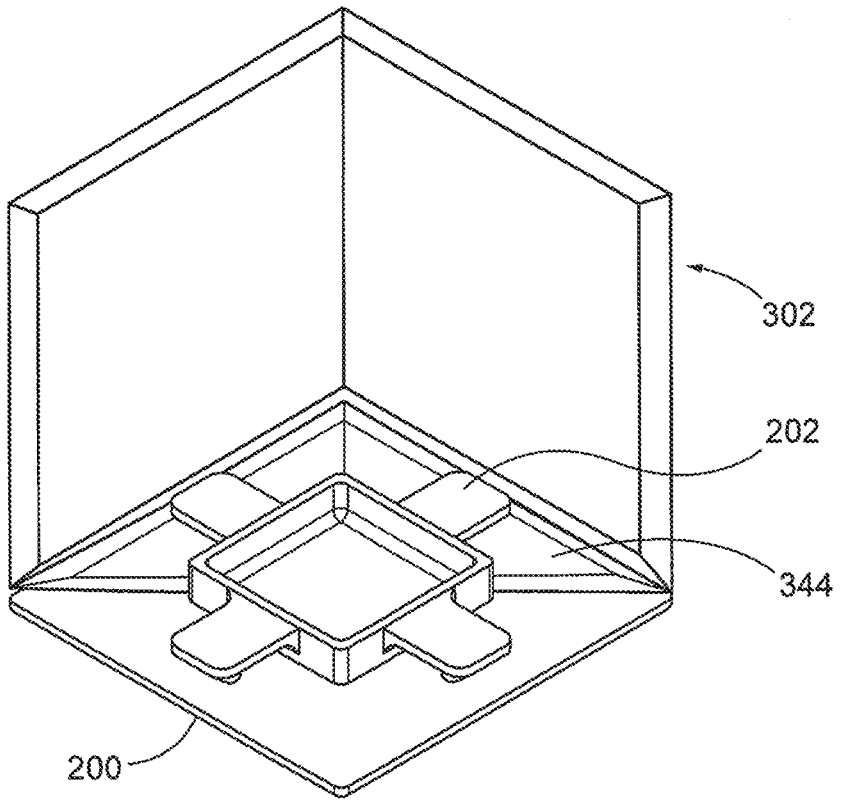

FIG. 3C shows an image display 300 on the image side 304 of image base 302 comprising an adhesive layer 306 covered by protective layer 308. Upon removal of protective layer 308, an image may be affixed (mounted) to all or a portion of image side 304. In one embodiment, an image is mounted to the image side 304 of the base prior to assembly of the planar base into its tertiary structure comprising a cube-shaped image display. FIG. 3D shows fastener 200 attached to a distal end 350 by engagement with the retainer (tab 202) of fastener 200. FIG. 3E shows a fully assembled image display 300, including the folded base 302 secured by the fastener 200 and also including (optional) hanging means 303 for hanging the fully assembled image display 300. FIG. 3F shows and internal view of image display 300, showing the interlocking fastener 200 attached to distal ends 344 of base, the fastener 200, in part, forming a non-image side of the assembled cube-shaped image display.

Figure 4A:
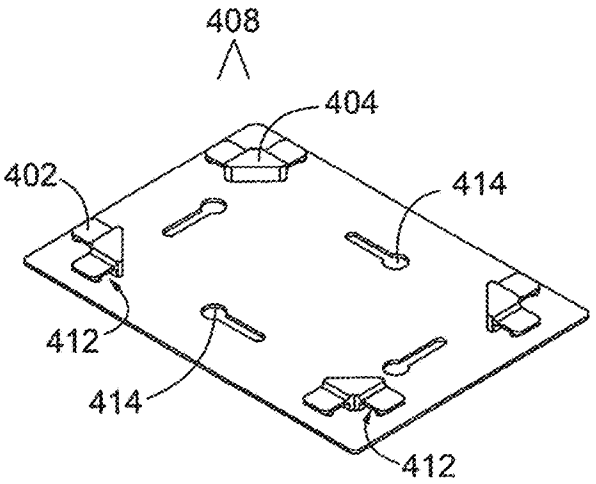
FIGS. 4A-4D show various views of an interlocking fastener, which attaches to one or more distal ends of the image display base configured for an image display comprising a rectangular shaped structure (when fully assembled).
Figure 4B:
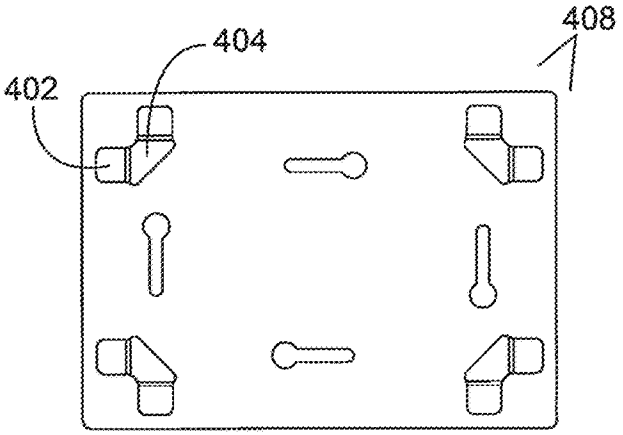
Figure 4C:
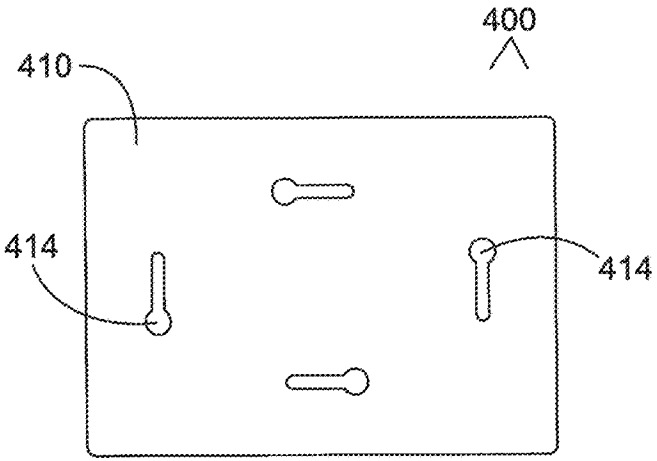
Figure 4D:
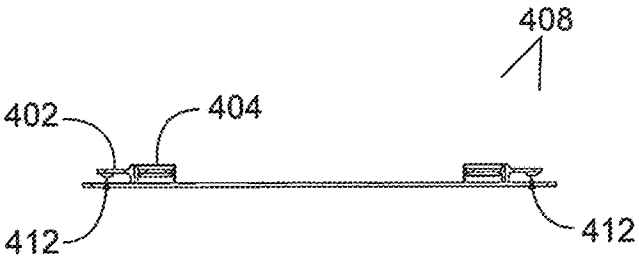

FIGS. 4A-4D shows fastener 400, comprising a plurality of fastening members 404 located on an upper surface 408 of fastener with cantilever tabs 402 having retainers 412 that engage dints (or protrusions) on the image display base and form an interlocking fastening mechanism. FIG. 4C shows a back panel side of fastener 400, comprising hanging means 414 comprising apertures for engaging with a hanging fastener secured to a wall or other hanging surface, for display.

Figure 5A:
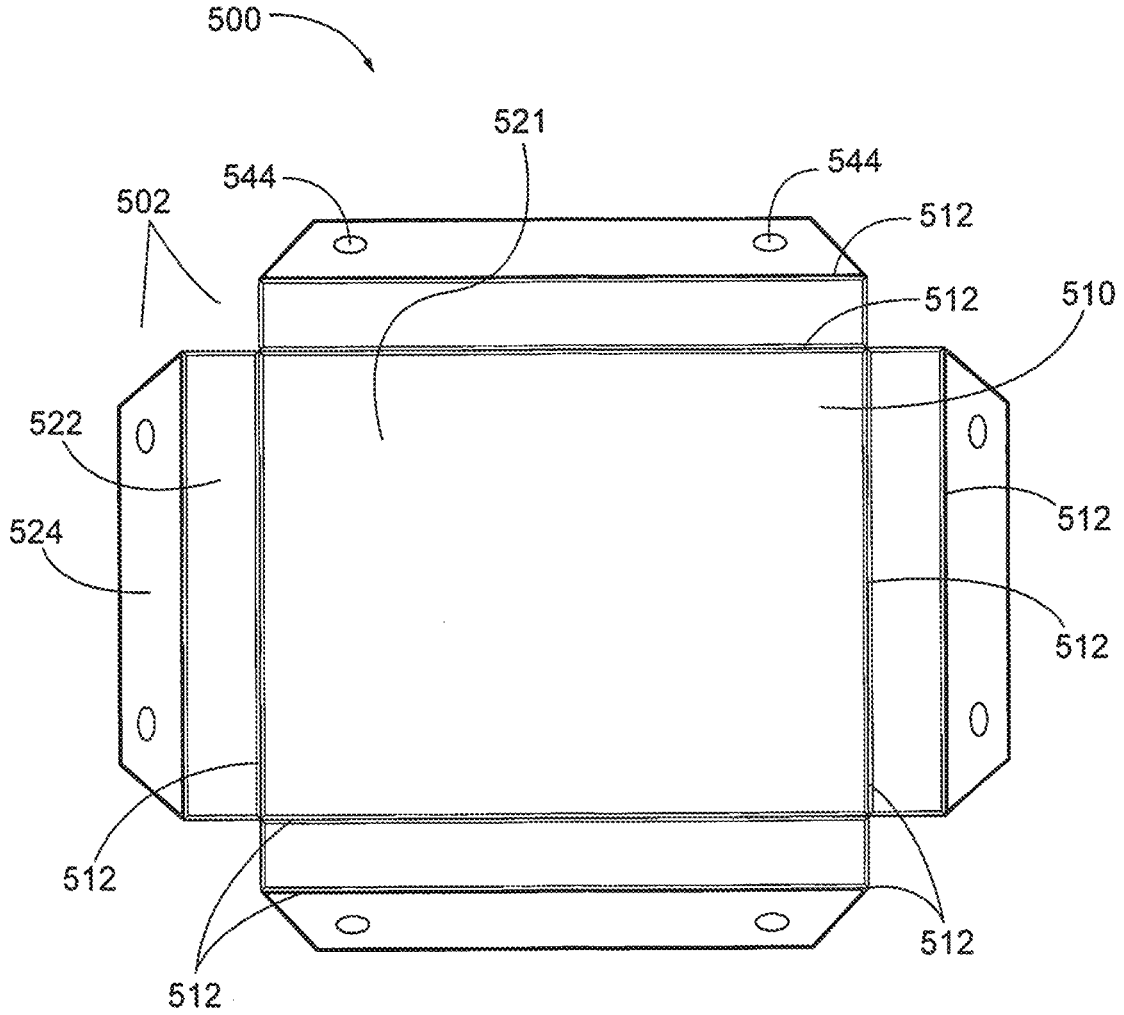
FIGS. 5A and 5B show a front and back side of an image display base according to one embodiment of the invention.
Figure 5B:
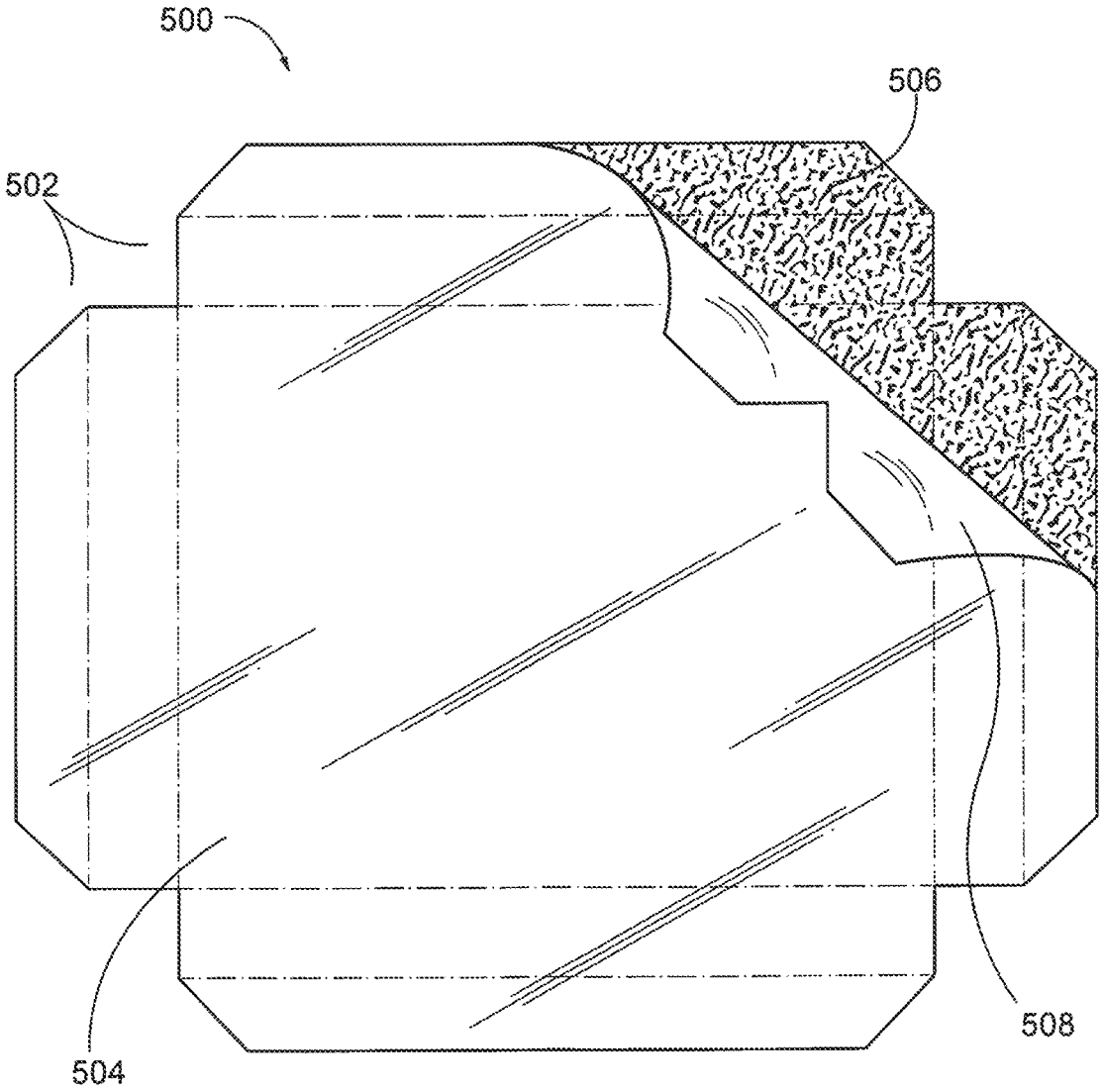
Figure 5C:
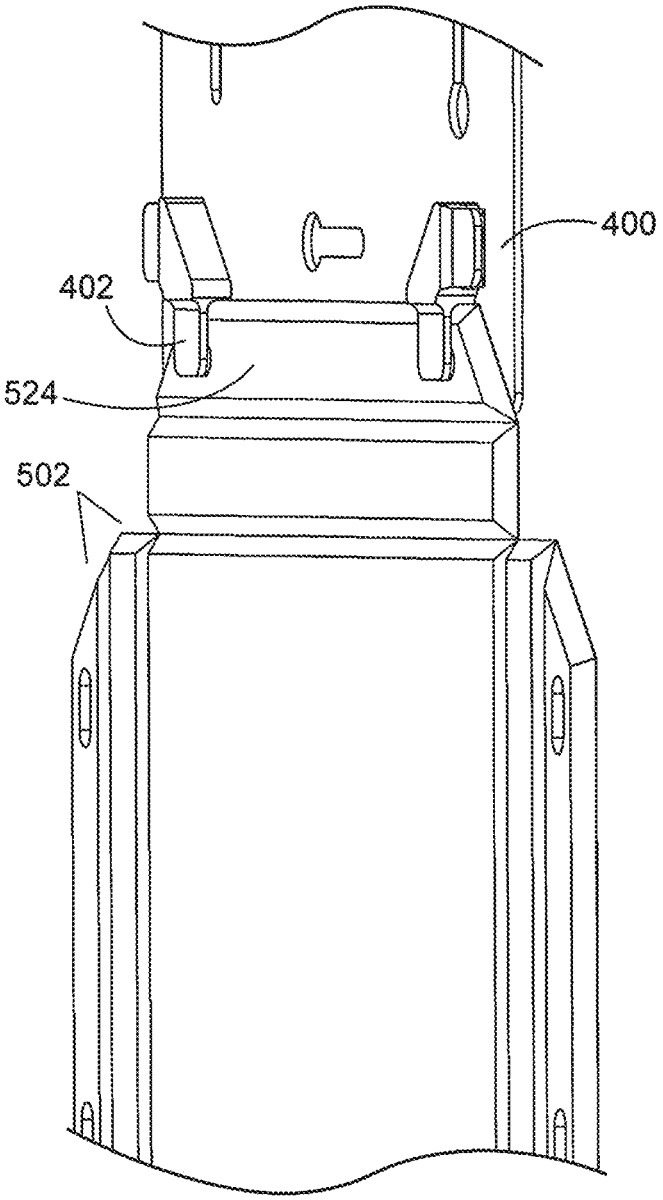
FIG. 5C shows an expanded view of an image display base connected to an interlocking fastener, according to one embodiment of the invention.

FIGS. 5A and 5B, collectively, show an image display assembly 500 according to one embodiment of the present invention, comprising a planar base 502 with an image display side (not visible in figure), a non-image side 510, and an arrangement of eight (8) v-grooves 512 on the non-image side of the base 510, wherein the arrangement of v-grooves 512 subdivide the base into a central segment 521, a first extension 522 extending from the central segment 521 along an outer length, and a second extension 524 extending outward from the first extension 522, so that upon inward folding of the first extension 522 toward central segment 521 at a hinge point of the v-groove 512, a side wall (as shown in FIG. 6) of the image display tertiary structure is created, and upon inward folding of the second extension 524 inward toward the first extension 522, the fastener is snapped into position by engaging tabs or protrusions 412 with one or more dints 544, thereby forming a back cover from the dorsal side of the fastener.

FIG. 58 shows an image display 500 on the image side 504 of image base 502 comprising an adhesive layer 506 covered by protective layer 508. Upon removal of protective layer 508, an image may be affixed (mounted) to all or a portion of image side 504. In one embodiment, an image is mounted to the image side 504 of the base prior to assembly of the planar base into its tertiary structure comprising a cube-shaped image display. FIG. 6C shows an expanded view of the fastener 400 attached at a distal end of base segments 524 by securing the retainer 402 (e.g. fastener tab) to the distal end 524 of base segment, forming an interlocking arrangement of the base 502 and fastener 400.

Figure 6A:
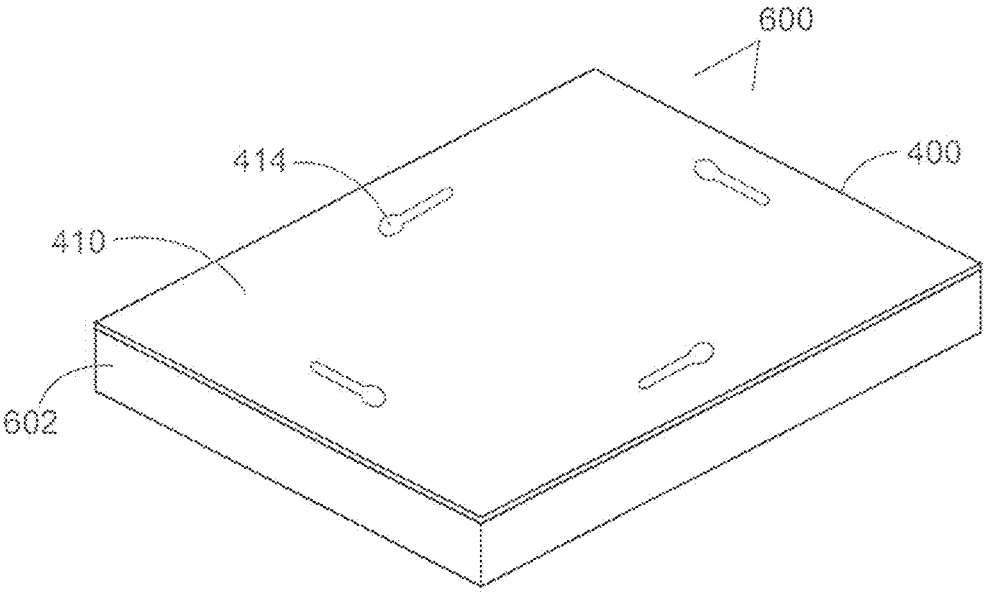
FIGS. 6A and 6B show a front and back side of a fully assembled image display according to one embodiment of the invention.
Figure 6B:
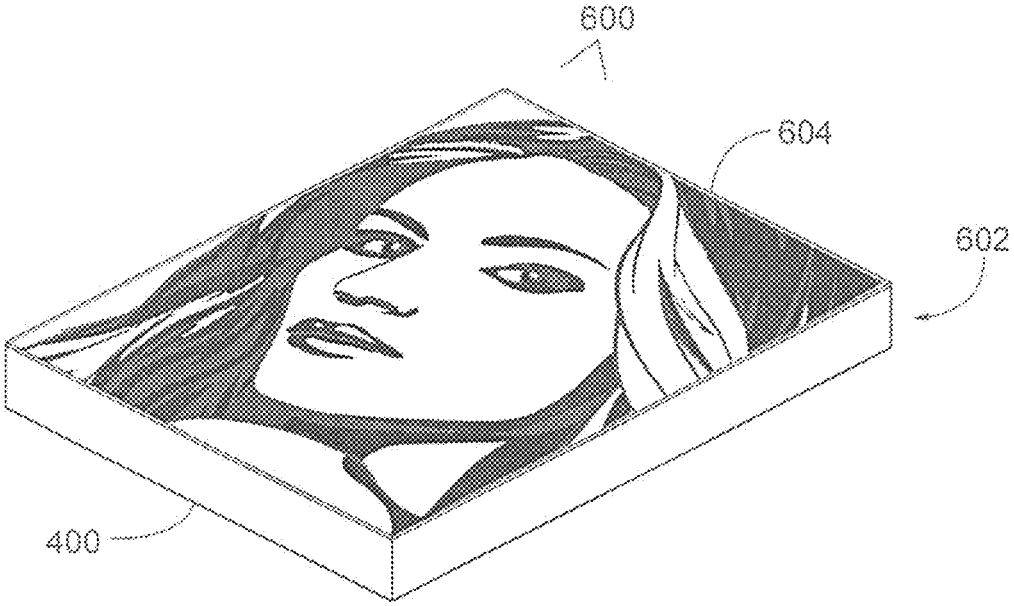

FIGS. 6A and 6B show an assembled image display. FIG. 6A shows non-image face formed by fastener 400 comprising hanging means 414, which is attached to base 602 and forms, in this example, a back side 410 of the fully assembled image display 600. FIG. 6B shows the image face 604 of base 602 connected to fastener 400 to form a fully assembled image display 600.

Figure 7:
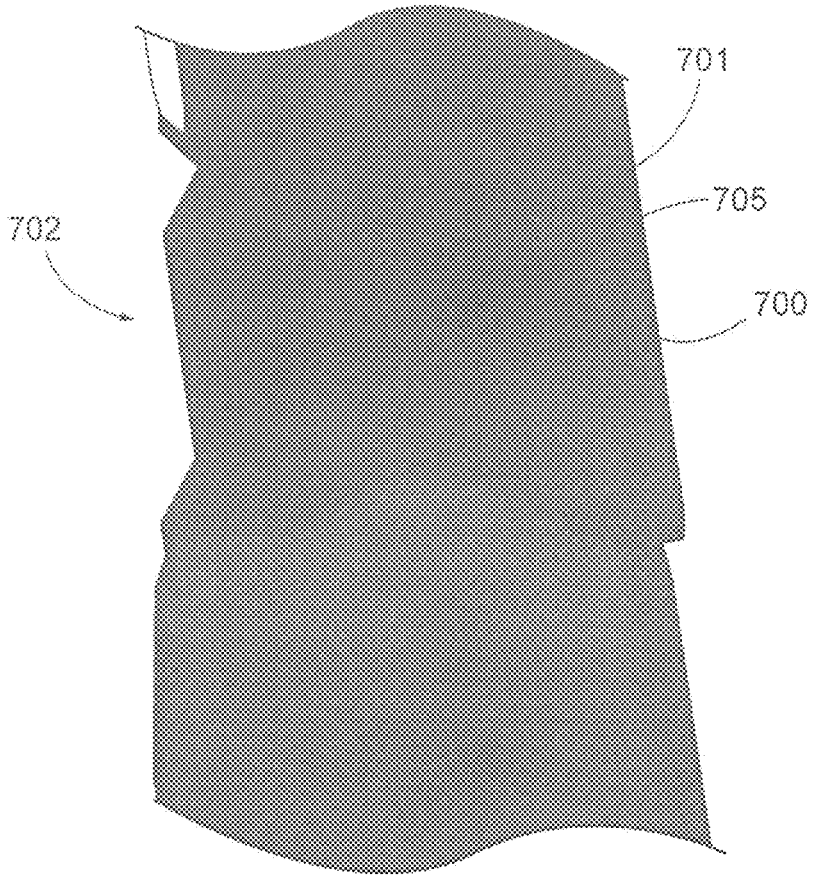
FIG. 7 shows an expanded view of an image display base connected to an interlocking fastener, according to another embodiment of the invention.

FIG. 7 shows a detailed view of fastener 700 comprising retainer 701 coupled to image display base 702, upon insertion of distal end of image display base 702 into the retainer space created between the retainer 701 and the fastener base. Ideally, the gap between the retainer 701 and base of fastener 700 is commensurate in size with the thickness of the segment of the image display base 702, so that retainer 701 and fastener base fit snugly and encase the segment of image display base therein.

Figure 8:
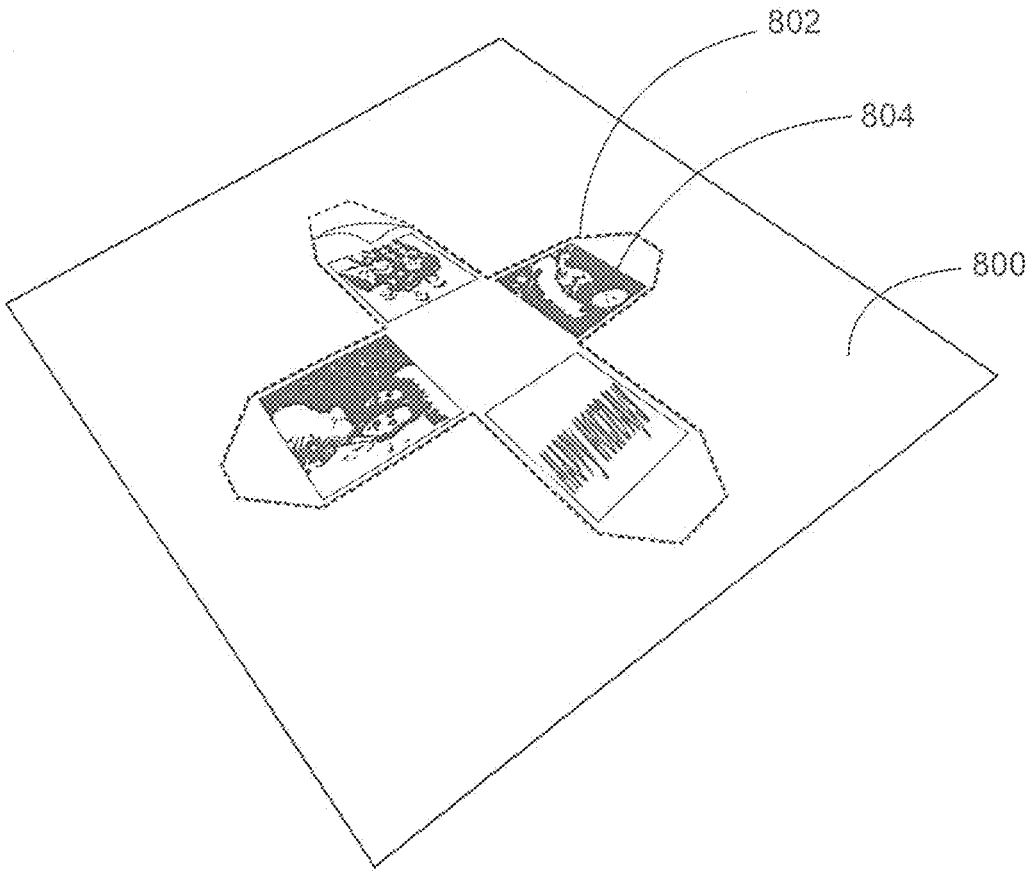
FIG. 8 shows an exemplary image sheet according to one embodiment of the invention.

FIG. 8 shows an exemplary image sheet 800 of the invention, comprising a perforated perimeter 802 comprising perforation defining an image area 804. The perforated perimeter is substantially equal to the perimeter of the image display base in planar form, such as the image display base shown in FIG. 3 (although other image areas are envisioned depending on the perimeter and shape of the base). The image comprising image area 804 is released from the sheet along the perforations, and is in turn mounted to the image surface of the unassembled base. In one embodiment, image is printed on image sheet 800, such as a digital image printed on paper or canvas; alternatively the image may be drawn, painted or affixed to image area, or any combinations thereof.

It will be clear to a person skilled hi the art that features disclosed in relation to any of the embodiments disclosed above can be applicable interchangeably between the different embodiments. The embodiments disclosed above are examples to illustrate various features of the invention.

Throughout the description and claims of this specification, the singular encompasses the plural unless the context otherwise requires. In particular, where the indefinite article is used, the specification is to be understood as contemplating plurality as well as singularity, unless the context requires otherwise.

What is claimed is:

1. An image display assembly comprising:

an image display base comprising:

a center section comprising a first outer surface having an image disposed thereon, and a plurality of foldable segments extending away from the center section and configured to fold relative to the center section, the plurality of foldable segments comprising distal ends, wherein:

the center section and the plurality of foldable segments form a hollow interior, and at least a portion of the distal ends are spaced from one another to define and surround an entrance opening to the hollow interior;

a fastener comprising a planar body and a plurality of space L-shaped cantilever tabs extending parallel to the planar body to form a space therebetween, wherein the fastener is configured to couple to each of the distal ends to form an assembled image display when distal ends are inserted into the space, wherein the fastener defines a second outer surface of the image display base opposite the first outer surface, wherein the plurality of foldable segments comprises a first foldable segment extending from a first edge of the center section, wherein the first foldable segment comprises one of the distal ends, and a second foldable segment extending from a second edge of the center section opposite the first edge, wherein the second foldable segment comprises another of the distal ends, and wherein the distal ends of the first and second foldable segments couple with the fastener.

2. The image display assembly of claim 1, wherein the fastener comprises a fastening member body that extends at least partially through the entrance opening of the hollow interior, and the plurality of spaced L-shaped cantilever tabs extend from the fastening member body and are configured to couple with the distal ends of the image display base.

3. The image display assembly of claim 1, wherein each of the plurality of spaced L-shaped cantilever tabs comprise a protrusion extending toward the planar body.

4. The image display assembly of claim 3, wherein each of the distal ends comprise a retaining feature configured to couple with the protrusion of the plurality of spaced L-shaped cantilever tabs.

5. The image display assembly of claim 1, wherein the center section forms a first side of the image display, the fastener forms a second side of the image display opposite the first side.

6. The image display assembly of claim 5, wherein the plurality of foldable segments forms sides of the image display between the first side and the second side.

7. The image display assembly of claim 5, wherein the first side has equal dimensions to the second side.

8. The image display assembly of claim 1, wherein each of the plurality of foldable segments forms a corner with an adjacent one of the plurality of foldable segments.

9. The image display assembly of claim 1, wherein the image display base is generally planar in an unassembled form.

10. The image display assembly of claim 1, wherein the image display base comprises an adhesive layer applied to an exterior face of the image display base and a removable protective layer covering the adhesive layer.

11. The image display assembly of claim 10, further comprising an image sheet comprising an image.

12. The image display assembly of claim 1, comprising four distal ends.

13. The image display assembly of claim 1, wherein the plurality of foldable segments comprises four foldable segments.

14. The image display of claim 1, wherein the plurality of foldable segments further comprises a third foldable segment extending from a third edge of the center section, wherein the third foldable segment comprises one of the distal ends, and a fourth foldable segment extending from a fourth edge of the center section opposite the third edge, wherein the fourth foldable segment comprises another of the distal ends, and wherein the distal ends of the third and fourth foldable segments couple with the fastener.

15. An image display assembly comprising:

an image base including four foldable segments configured to form a support structure defining a hollow interior in an assembled configuration, wherein in the assembled configuration, at least a portion of distal ends of the four foldable segments are spaced from one another to define an entrance to the hollow interior and the four foldable segments surrounds the hollow interior; and a fastener comprising a planar body and four spaced cantilever tabs extending parallel to the planar body to form a space therebetween, wherein each of the four spaced cantilever tabs of the fastener is configured to connect with the distal end of a different one of the four foldable segments when the distal end is inserted into the space, and wherein the planar body substantially covers the entrance to the hollow interior in the assembled configuration.

16. The image display assembly of claim 15, wherein the fastener comprises a fastening member body that extends at least partially through the entrance of the hollow interior and the four spaced cantilever tabs extend from the fastening member body and are configured to couple with the distal ends of the image base.

17. The image display assembly of claim 15, wherein each of the four spaced cantilever tabs comprises a protrusion extending toward the planar body.

18. The image display assembly of claim 17, wherein the distal ends each comprise a retaining feature configured to couple with one of the protrusions of the four spaced cantilever tabs.

19. The image display assembly of claim 15, wherein the image base is at least generally planar in an unassembled form.

20. The image display assembly of claim 1, wherein the distal ends entirely surround the entrance opening to the hollow interior.

* * * * *